US006932362B1

(12) United States Patent
Barrett

(10) Patent No.: US 6,932,362 B1
(45) Date of Patent: Aug. 23, 2005

(54) SKATEBOARD AXLE ASSEMBLY

(76) Inventor: Mark Barrett, 25610 W. Seven Mile Rd., Redford, MI (US) 48240

( * ) Notice: Subject to any disclaimer, the term of this patent is extended or adjusted under 35 U.S.C. 154(b) by 1 day.

(21) Appl. No.: 10/455,583

(22) Filed: Jun. 5, 2003

Related U.S. Application Data

(60) Provisional application No. 60/386,779, filed on Jun. 6, 2002.

(51) Int. Cl.[7] ..... A63C 1/00
(52) U.S. Cl. ..... 280/11.27
(58) Field of Search ..... 280/11.27, 11.28, 280/87.041, 87.042

(56) References Cited

U.S. PATENT DOCUMENTS

| | | | | |
|---|---|---|---|---|
| 2,502,153 A | * | 3/1950 | Jack | 280/11.28 |
| 3,862,763 A | | 1/1975 | Ware | |
| 4,060,253 A | | 11/1977 | Oldendorf | |
| 4,120,508 A | | 10/1978 | Brown et al. | |
| 4,120,510 A | | 10/1978 | Hillard | |
| 4,152,001 A | | 5/1979 | Christianson | |
| 4,155,565 A | | 5/1979 | de Caussin et al. | |
| 4,159,830 A | * | 7/1979 | Solimine | 280/11.28 |
| 4,251,087 A | | 2/1981 | Hansen | |
| 4,311,319 A | * | 1/1982 | Snyder et al. | 280/11.28 |
| 4,398,734 A | | 8/1983 | Barnard | |
| 4,596,396 A | * | 6/1986 | Merbler | 280/11.28 |
| 2004/0140633 A1 | * | 7/2004 | Beedle et al. | 280/11.27 |

* cited by examiner

*Primary Examiner*—Bryan Fischmann
(74) *Attorney, Agent, or Firm*—Charles W. Chandler

(57) ABSTRACT

A skateboard axle assembly includes a base attached to the underside of a skateboard, and a hanger which supports the axle. The hanger is connected to the base by a bolt and two nylon washers that permit a slight motion of the axle with respect to the base when the skateboard user makes a turn. In addition a small stud mounted on the hanger screws into the base an adjusted depth to adjust the clearance between the wheels and the skateboard.

5 Claims, 6 Drawing Sheets

SKATEBOARD AXLE ASSEMBLY

CROSS-REFERENCE TO RELATED APPLICATION

This application is claiming domestic priority to Provisional Patent Application filed Jun. 6, 2002, Ser. No. 60/386,779 for SKATEBOARD AXLE ASSEMBLY.

BACKGROUND AND SUMMARY OF THE INVENTION

Skateboards use a truck for supporting the board on wheels. Some prior art skateboards may be found in U.S. Pat. No. 4,398,734 issued Aug. 16, 1983 to Robert G. Barnard for "Truck Design for a Skate-Type Device"; U.S. Pat. No. 4,251,087 issued Feb. 17, 1981 to H. Gordon Hansen for "Truck Apparatus for Skate and Skateboard Devices"; U.S. Pat. No. 4,155,565 issued May 22, 1979 to David M. de Caussin et al. for "Adjustable Skateboard"; U.S. Pat. No. 4,152,001 issued May 1, 1979 to Tony Christianson for "Skateboard Truck"; U.S. Pat. No. 4,120,510 issued Oct. 17, 1978 to Thomas Gerald Hillard for "Wheeled Skateboards"; U.S. Pat. No. 4,120,508 issued Oct. 17, 1978 to John Steven Brown et al. for "Wheeled Skateboards"; U.S. Pat. No. 4,060,253, issued Nov. 29, 1977 to Eric W. Oldendorf for "Method and Apparatus for Skateboard Suspension System"; and U.S. Pat. No. 3,862,763 issued Jan. 28, 1975 to Gordon K. Ware for "Roller Skate Construction with Releasably, Lockable and Adjustable Action Screw".

In general, the prior art limits adjusting the distance the wheels and the skateboard while permitting the wheel angle tilt to accommodate the angle of a skateboard during a turn.

The broad purpose of the present invention is to provide an improved skateboard truck construction, in which the skateboard to wheel ground distance is adjustable, allowing the rider to use one skateboard for many currently commercially available axle assembly heights.

Still further objects and advantages of the invention will become readily apparent to those skilled in the art to which the invention pertains upon reference to the following detailed description of the drawings.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
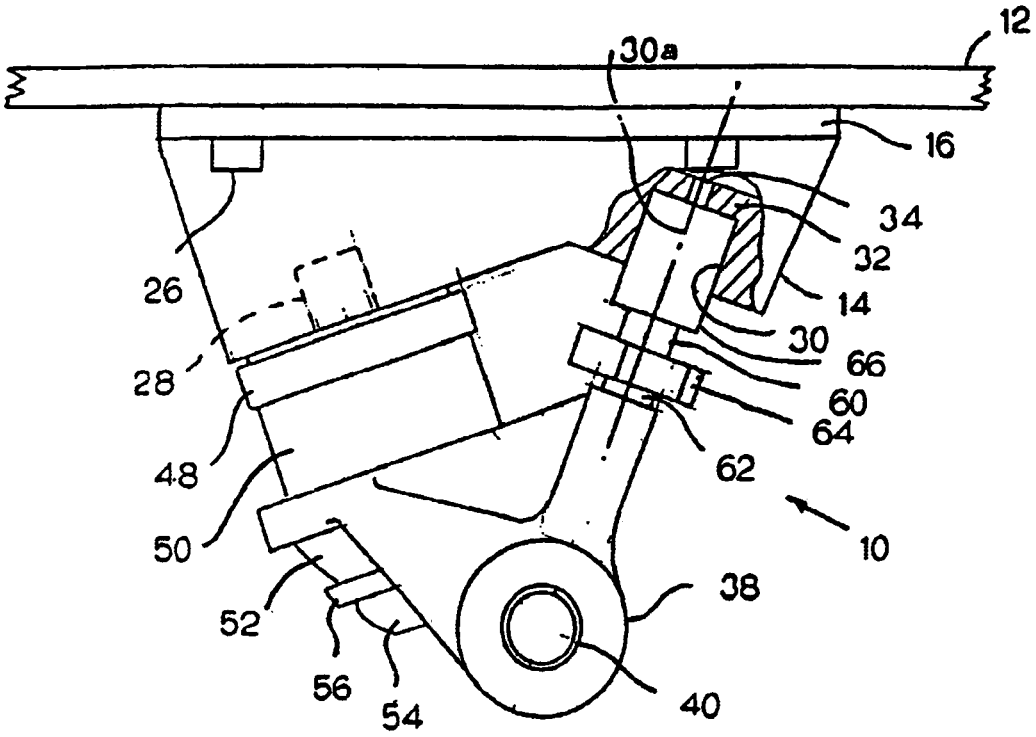
FIG. 1 is a view of a preferred skateboard truck separated from the wheels and showing the skateboard fragmentarily.
Figure 2:
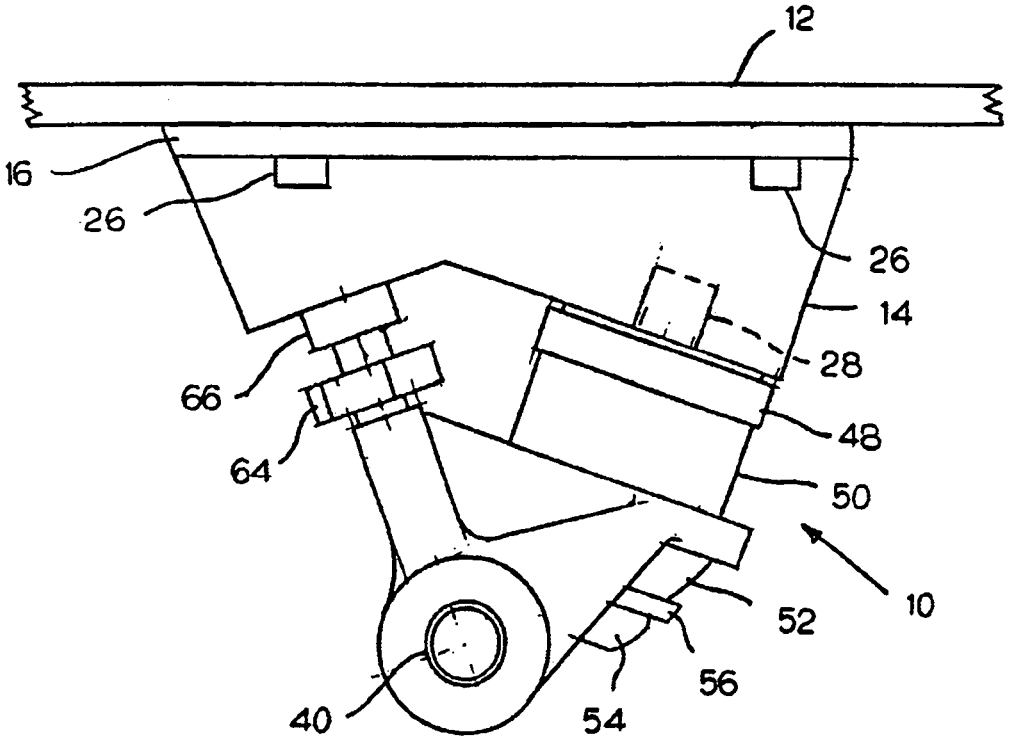
FIG. 2 is a view similar to FIG. 1, but showing the opposite side of the skateboard truck.
Figure 3:
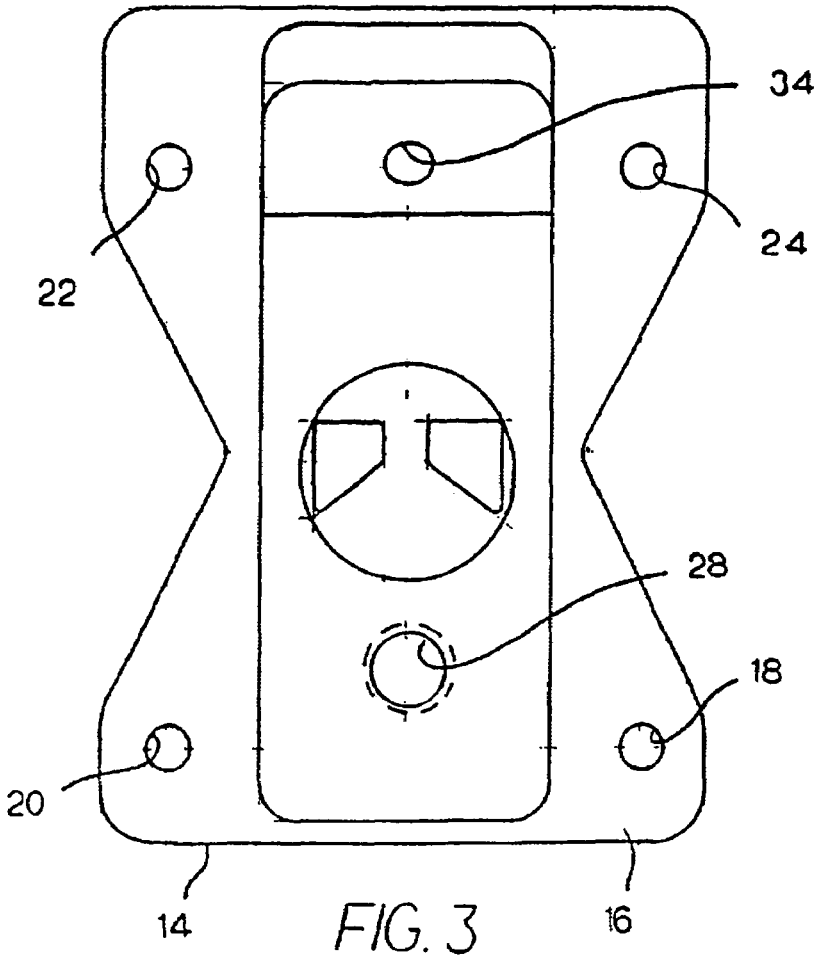
FIG. 3 is a view of the base separated from the other components.

Referring to the drawings, FIGS. 1 and 2 illustrate a preferred truck 10 mounted on the lower surface of a skateboard 12. Truck 10 includes a metal base 14. Referring to FIGS. 3 and 9–11, base 14 includes a flange 16 having openings 18, 20, 22, and 24 for receiving four fastener means 26 which attach the base to the skateboard.

The base includes a tapped hole 28 formed on an axis 28*a* that is inclined with respect to flange 16. The base also has a cylindrical cavity 30 also formed along an axis 30*a* that is inclined with respect to flange 16 and toward tapped hole 28. Cavity 30 has a wall 32 with an opening 34 aligned along central axis 30*a* of the cavity.

Figure 4:
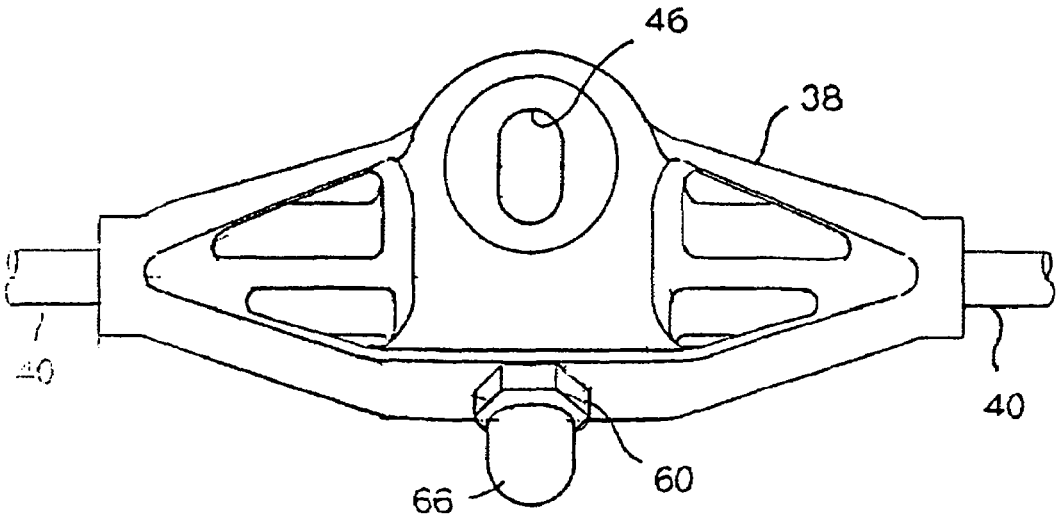
FIG. 4 is a view of the axle housing.
Figure 5:
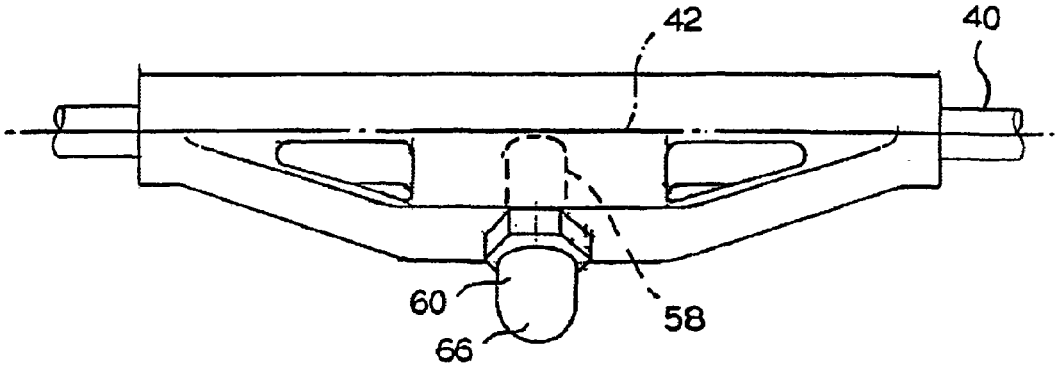
FIG. 5 is another view of the axle housing.
Figure 6:
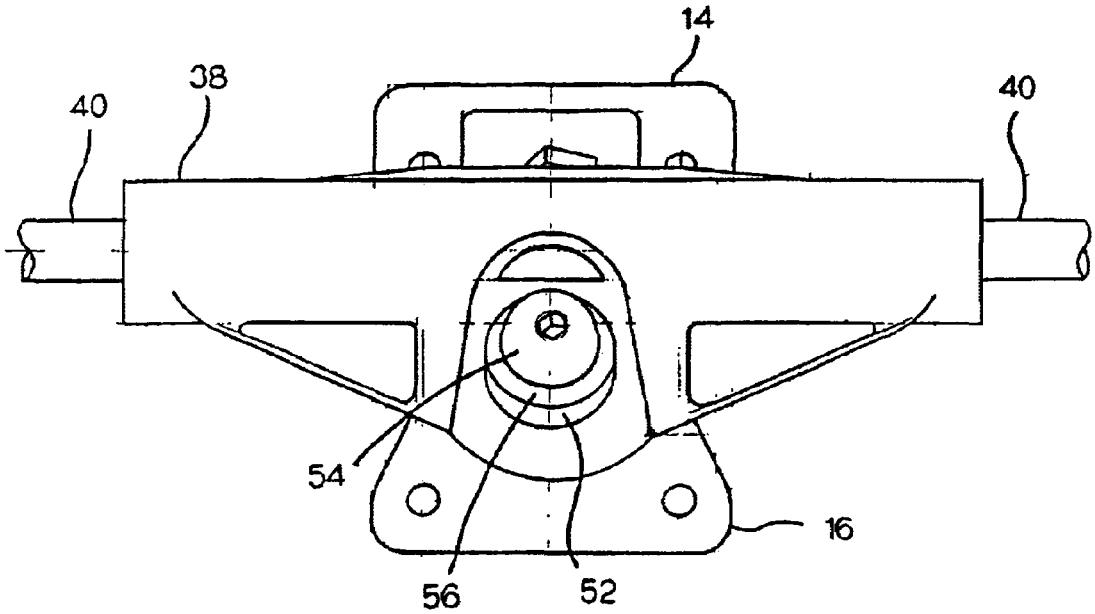
FIG. 6 is a bottom view of the preferred truck.
Figure 7:
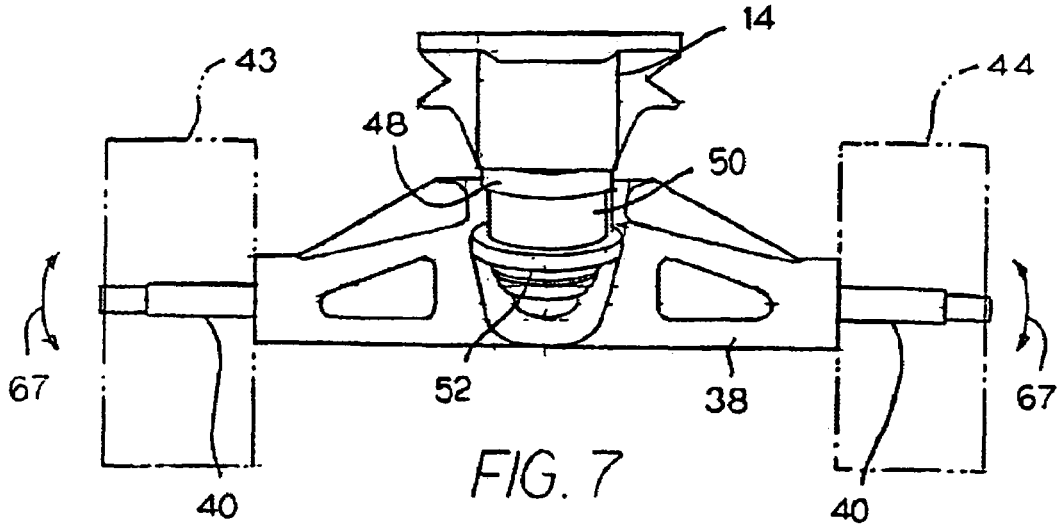
FIG. 7 is a view as seen from the right side of FIG. 2.

Referring to FIGS. 4 and 5, the truck has an elongated yoke 38 for supporting an axle 40 along an axis of rotation 42. Axis 42 is at right angles and intersects central axis 30*a* of cavity 30. A pair of wheels 43 and 44, illustrated in phantom, in FIG. 7 are mounted on opposite ends of axle 40.

Figure 9:
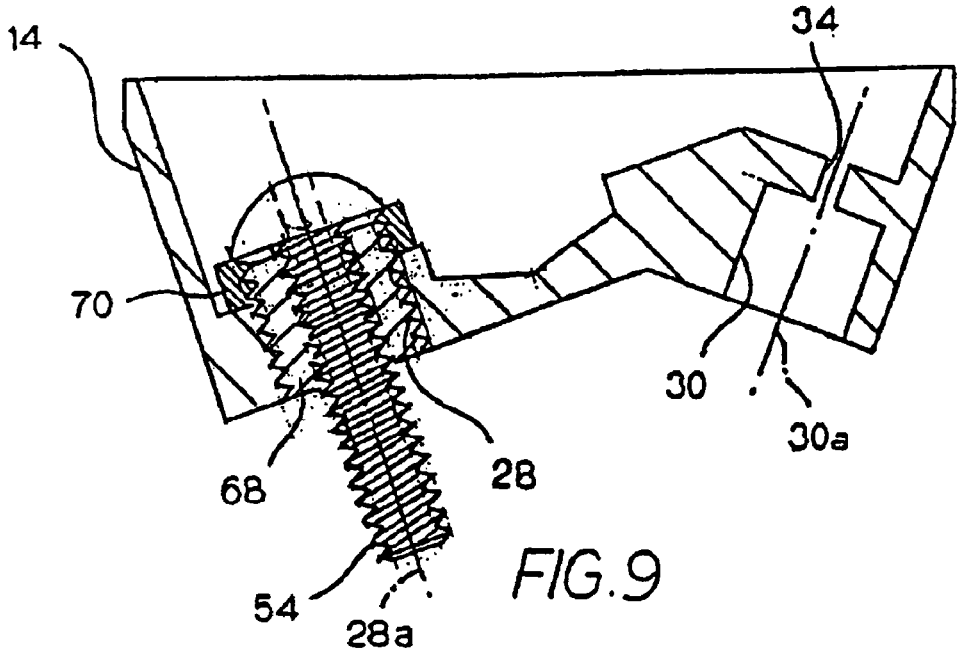
FIG. 9 is a sectional view through the base to show the position of the king pin bolt.

The yoke has a central opening 46 as best seen in FIG. 4, aligned with tapped hole 28. Referring to FIG. 1, a metal annular cap 48 is seated against the lower surface of the base with a central cap opening aligned with tapped hole 28. A pair of compressible resilient nylon pads 50 and 52 each having a central opening, are mounted on the yoke on opposite sides of opening 46. The outside cylindrical surface of the two pads has a slightly larger diameter than the diameter of central opening 46. A button head Allen screw 54 (king pin bolt) with a washer 56 is threaded through pads 50 and 52. Screw 54 is threadably mounted in tapped opening 28 so that the two pads are tightly sandwiched between the head of the bolt and the base. The Allen screw can be reversed that is the rounded head of the screw disposed in opening 28 as shown in FIG. 9. A nut would then be mounted on the outer end of the Allen screw.

The two pads are slightly resilient to permit an angular tilting motion between the yoke and the base.

Figure 8:
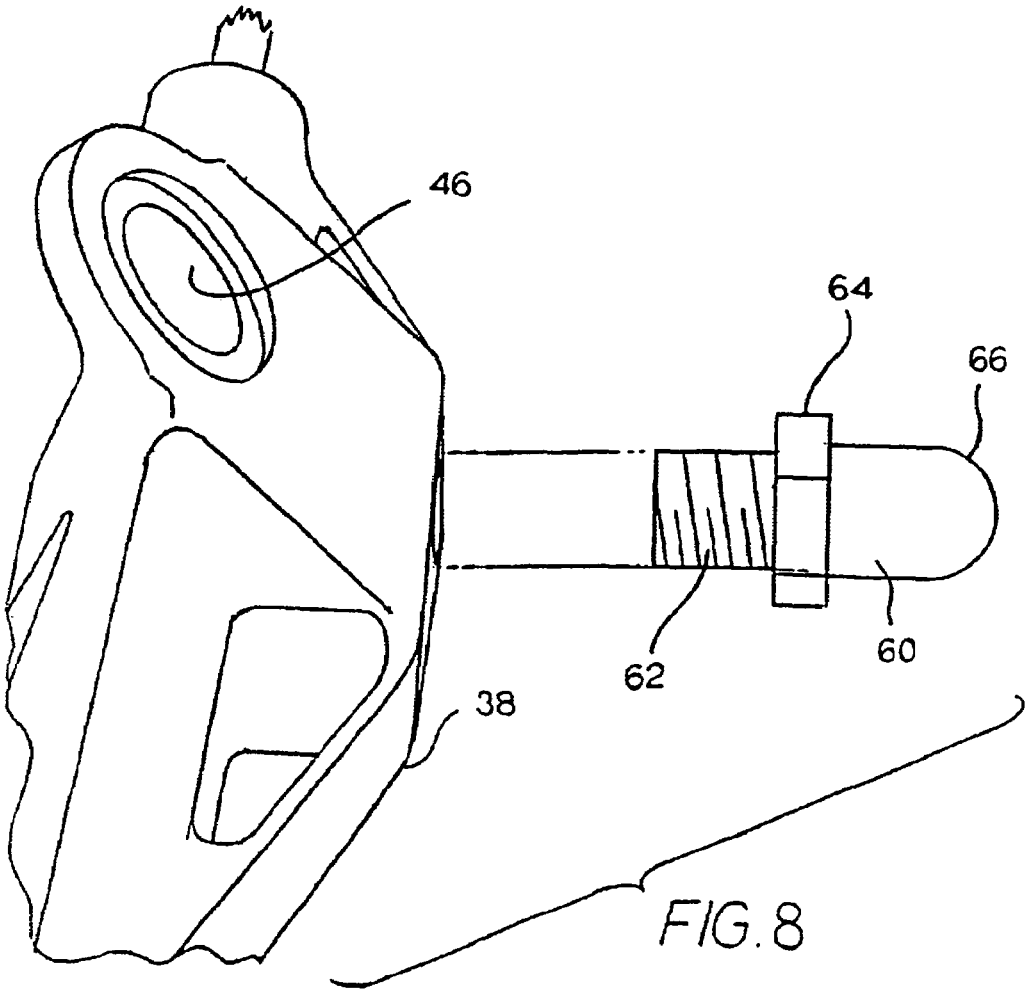
FIG. 8 is a view showing the adjusting nut and the axle housing.

Referring to FIG. 5, the yoke has a tapped opening 58 for receiving an elongated threaded adjusting member 60. Referring to FIG. 8, adjusting member 60 has a threaded end 62 which is threadably received into tapped opening 58. Adjusting member 60 carries an adjusting nut 64. The upper end of the adjusting member has a rounded configuration 66 slidably received in cavity 30 in the base. Axis 30*a* of the cavity lies in a plane that intersects rotational axis 42 of the axle.

Referring to FIG. 1, the distance between axle 40 and the skateboard is adjusted by adjusting the depth the threaded end 62 of the adjusting member is screwed into tapped hole 28. To increase the distance between the axle and the skateboard, adjusting member 60 is unscrewed to a desired location and then locked in position by nut 64. This will increase the distance between the axle and the bottom of the skateboard.

Further, the sliding fit between the adjusting member and cavity 30 permits the axle and the yoke to swing in an arc 67 (see FIG. 7) in such a manner that one end of the axle can move upwardly and the other end downwardly as the skateboard moves in a turn.

Figure 10:
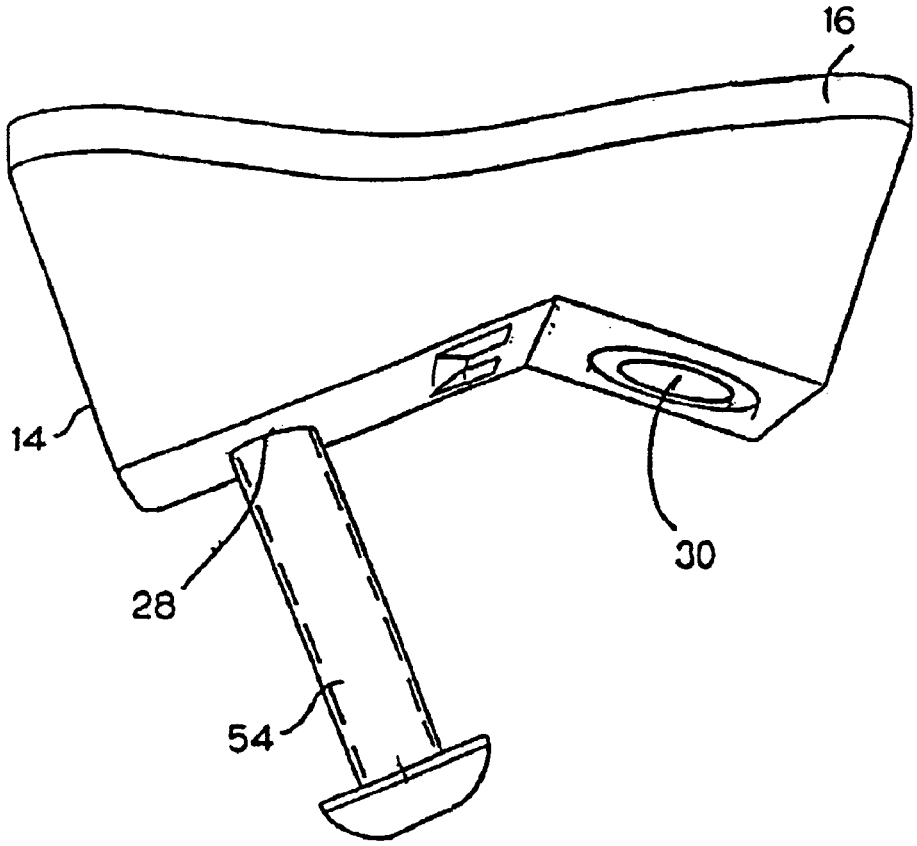
FIGS. 10 and 11 show alternate positions of the king pin bolt mounted on the base.
Figure 11:
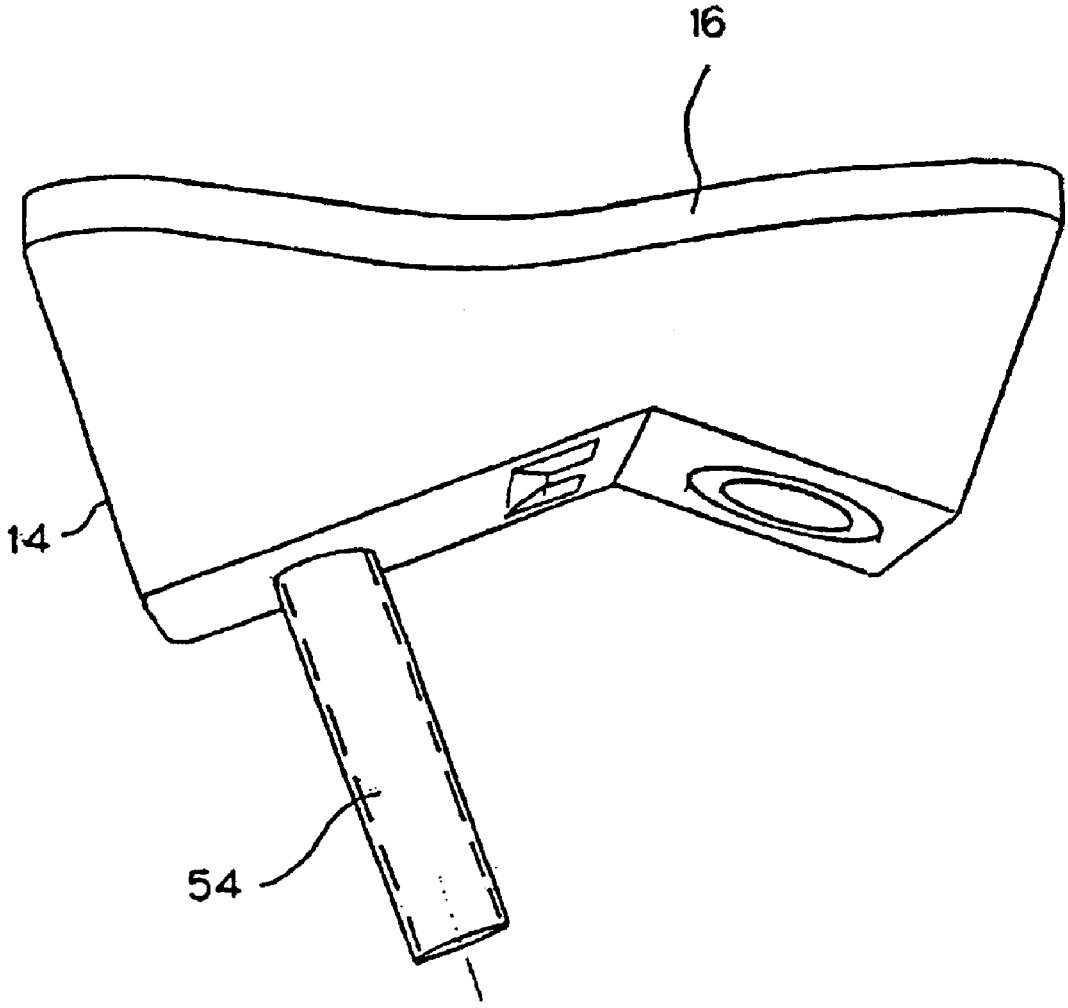

Referring to FIGS. 9–11, allen screw 54 may be mounted in alternate positions on the base. FIG. 10 illustrates the manner in which it is mounted as shown in FIG. 1.

FIGS. 9 and 11 illustrate an alternate method for mounting alien screw 54. In either case a stainless steel internally and externally threaded sleeve 68 is mounted in tapped hole 28. In the embodiment of FIGS. 9 and 11, an aluminum hex nut

70 is mounted on the inside end of the sleeve, beneath tapped hole 28 to function as a spacer. Button head alien screw 54 is screwed through the inside of the base so that the threaded end of the screw extends toward yoke 38 and through opening 46. The compressible pads 50 and 52 are then mounted on the exposed end of screw 54 and secured by a nut, not shown.

Thus, it is to be understood that I have described an improved skateboard truck which permits the axle to swing slightly in order to accommodate the user of the skateboard moving in a turn. Further, the truck permits the user to adjust the distance between the axle and the bottom of the skateboard to enhance his performance.

The outside diameter of the pads is slightly larger than the diameter of central opening 46.

Having described my invention, I claim:

1. A wheeled truck for a skateboard, comprising:

a base having an upper skateboard mounting surface, and means for attaching said upper mounting surface of the base to the underside of a skateboard;

a yoke (38) having a bottom opening (30);

a wheel axle having a longitudinal axis, mounted on the yoke;

said bottom opening having an axis forming an acute angle with respect to the mounting surface of the base;

an elongated threaded adjustment leg (60) having a rounded upper end received in the bottom opening (30) in the base, the adjustment leg having a longitudinal axis that intersects the axle axis and being disposed at an acute angle with respect to the mounting surface of the base, the rounded end permitting the yoke to tilt with respect to the base;

the adjustment leg having a lower end threadably connected to the yoke to adjust the distance between the axle and the base;

an elongated member (54) having an upper end connected to the base along an axis that lies in an acute angle with respect to the mounting surface of the base;

a pair of resilient pads (50, 52) having central apertures mounted on the elongated member, and structure carried on a lower end of the elongated member such that the resilient pads are sandwiched between the base and said structure;

a yoke structure sandwiched between the pair of resilient pads, such that the axle is movable with respect to the base;

a nut (70) threadably mounted on the adjustment leg and engaged with the yoke to lock the adjustment leg in an adjusted position; and the base having an internally threaded second bottom opening (28), and including a stainless steel internally threaded sleeve (68) disposed in said second bottom opening for receiving the upper end of the adjustment leg.

2. A wheeled truck as defined in claim 1, in which the axis of the adjustment leg intersects the longitudinal axis of the elongated member.

3. A wheeled truck as defined in claim 1, in which the rounded upper end of the adjustment member is slidably mounted in the bottom opening in the base.

4. A wheeled truck as defined in claim 1, including a pair of wheels mounted on the axle.

5. A wheeled truck as defined in claim 1, in which the axis of the elongated member intersects the longitudinal axis of the adjustment member at an acute angle.

* * * * *